US005427459A

United States Patent [19]

Makino

[11] Patent Number: 5,427,459

[45] Date of Patent: Jun. 27, 1995

[54] PRINTER WITH COMMAND INHIBITOR

[75] Inventor: Kyoko Makino, Shizuoka, Japan

[73] Assignee: Star Micronics Co., Ltd., Shizuoka, Japan

[21] Appl. No.: 140,787

[22] Filed: Oct. 21, 1993

[30] Foreign Application Priority Data

Oct. 30, 1992 [JP] Japan ..... 4-316100

[51] Int. Cl.[6] ..... B41J 5/00

[52] U.S. Cl. ..... 400/76; 395/112

[58] Field of Search ..... 400/61, 63, 70, 76; 395/106, 112, 114, 115, 150, 151

[56] References Cited

U.S. PATENT DOCUMENTS

| | | | |
|---|---|---|---|
| 4,856,924 | 8/1989 | Sugino | 400/703 |
| 4,994,988 | 2/1991 | Yokoi | 395/112 |
| 5,089,690 | 2/1992 | Okamura | 400/703 |

FOREIGN PATENT DOCUMENTS

| | | | |
|---|---|---|---|
| 219023 | 8/1987 | Japan | 400/76 |
| 1214464 | 8/1989 | Japan | 400/61 |
| 476461 | 7/1992 | Japan | 400/61 |

*Primary Examiner*—David A. Wiecking
*Assistant Examiner*—Steven S. Kelley
*Attorney, Agent, or Firm*—Whitham, Curtis, Whitham & McGinn

[57] ABSTRACT

Disclosed is a printer for making a printout in accordance with printing data containing a control command sent from a high rank apparatus. The printer comprises control means for changing and controlling a printing mode according to the control command sent from the high rank apparatus; memory means for storing predetermined set data; inhibiting means for inhibiting a control operation of the control means associated with a specific control command sent from the high rank apparatus in accordance with set contents of the set data; and indicating means for indicating the set contents of the set data in a mode in which the printer is ready to receive a control command from the high rank apparatus. Accordingly, the set status of a special mode for inhibiting the operation in response to a specific control command is indicated in a state where the printer is ready to receive printing data containing a control command from the high rank apparatus. Even when the printing data sent to the printer differs from the printing result, therefore, the user can easily understand the cause for the difference, thus significantly improving the operability of the printer.

14 Claims, 8 Drawing Sheets

PRINTER WITH COMMAND INHIBITOR

BACKGROUND OF THE INVENTION

1. Field of the Invention

The present invention relates to a printer, and, more particularly, to the contents of indication on a display portion, comprising light-emitting diodes (LED's) or the like, which is located on an operating panel.

2. Description of the Related Art

Several light indicating portions each incorporating an LED are provided in the display portion of a conventional printer. Those light indicating portions, when properly turned on or off, indicate various setting conditions of the printer.

This conventional structure has the following shortcoming. In the case where special modes associated with several control commands are set in the conventional printer, a user cannot check whether or not those special modes are set from the indication on the operating panel. At the time printing data such as a document prepared on a high rank apparatus like a host computer is sent to the printer to provide a desired printout, if the printout is done in an unexpected print status (line feed pitch, character font, character pitch, etc.), the user cannot see whether the different print status has occurred from an error in the printing data or from the set contents of the printer.

The prior art systems are disclosed in, for example, Japanese Unexamined Utility Model Publication No. hei 4-76461, Japanese Unexamined Patent Publication No. hei 1-214464.

SUMMARY OF THE INVENTION

It is therefore an object of the present invention to provide a printer which will indicate whether or not a special mode associated with a specific control command is set, when the printer is ready to receive printing data from a high rank apparatus.

To achieve this object, according to the present invention, there is provided a printer, connected to a high rank apparatus, for making a printout in accordance with printing data containing a control command sent from the high rank apparatus, which printer comprises control means for changing and controlling a printing mode according to the control command sent from the high rank apparatus; memory means for storing predetermined set data; inhibiting means for inhibiting a control operation of the control means associated with a specific control command sent from the high rank apparatus in accordance with set contents of the set data; and indicating means for indicating the set contents of the set data in a mode in which the printer is ready to receive a control command from the high rank apparatus.

The printer has switching means for switching the indication contents of the indicating means whereby indication of the indicating means is switched between indication of the set contents of the set data and indication of a selected status of a printing mode for printing printing data on a printing medium in accordance with a switching operation of the switching means.

The indicating mode for indicating the set contents of the set data may differ from the indicating mode of indicating the selected status of the printing mode.

The indicating means may comprise a plurality of light emitting portions.

A switch which serves as a FONT switch in off-line mode may be used directly as a changeover switch serving as the switching means in on-line mode.

Further, the set contents of the set data may be indicated by switching on and off the light emitting portions and the selected status of the printing mode may be indicated by keeping the light emitting portions on.

According to the present invention, the set status of a special mode for inhibiting the operation in response to a specific control command is indicated in a state where the printer is ready to receive printing data containing a control command from a high rank apparatus. Even when the printing data sent to the printer differs from the printing result, therefore, the user can easily understand the cause for the difference, thus significantly improving the operability of the printer.

DETAILED DESCRIPTION OF THE PREFERRED EMBODIMENT

Figure 1:
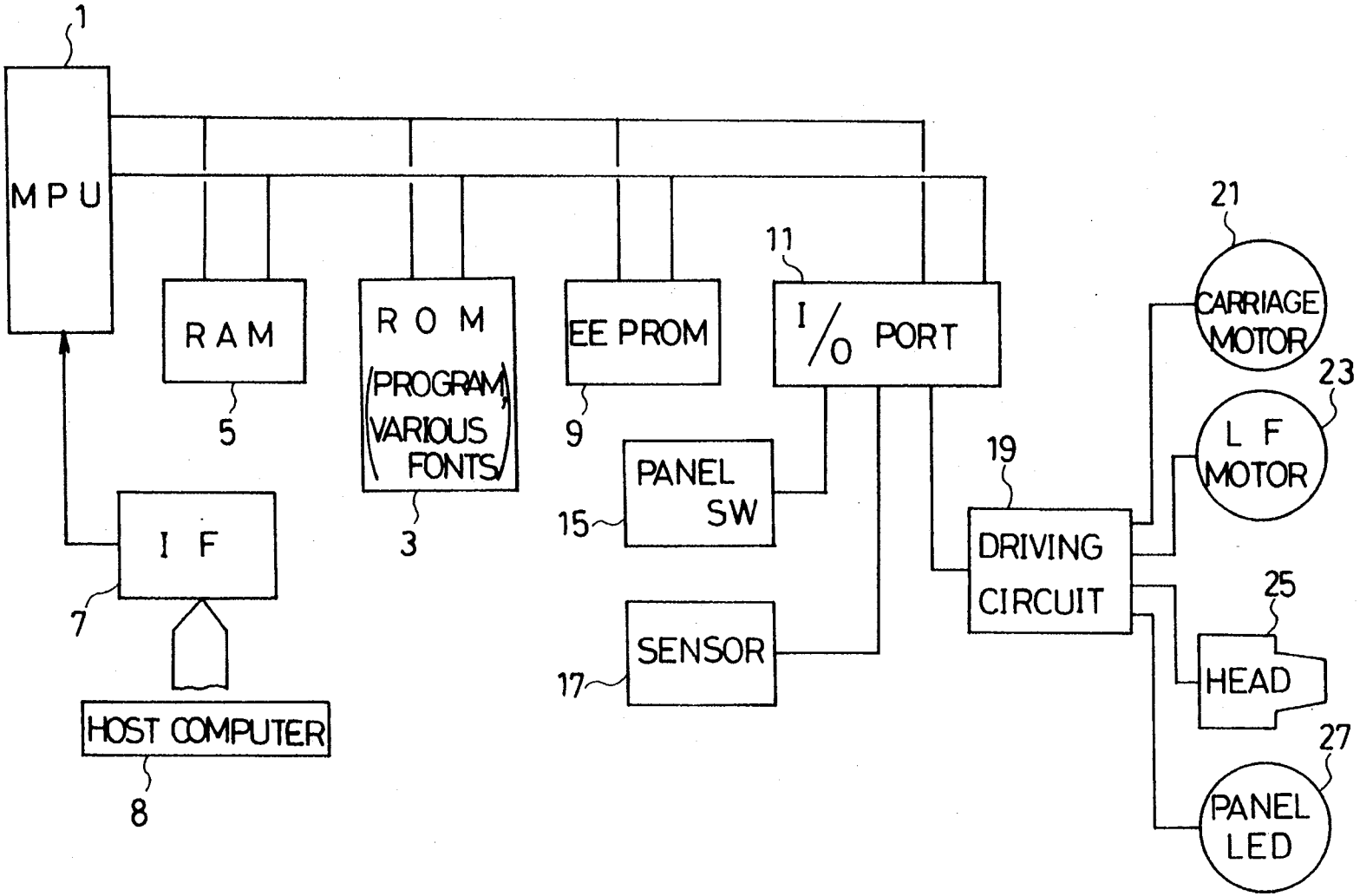
FIG. 1 is a block diagram illustrating a printer according to one embodiment of the present invention, and showing the structure of a control section of this printer.

A preferred embodiment of the present invention will now be described referring to FIGS. 1 through 7. To begin with, a description will be given of the structure of a printer according to this embodiment, mainly of the control section of the printer, with reference to FIG. 1. A microprocessor unit (hereinafter called "MPU") 1 performs the general control of the printer according to a program previously stored in a ROM (Read Only Memory) 3. A RAM (Random Access Memory) 5 is provided to store various pieces of internal data or temporarily store printing data which is input via an interface (hereinafter called "IF") 7 from a host computer 8. An EEPROM (Electrically Erasable and Programmable Read Only Memory) 9 is provided to store variable data which should be saved even when electric power is gone. When power is given, a series of data stored in the EEPROM 9 is collectively transferred to a work area in the RAM 5 and is initialized under designated conditions.

There is an I/O (input/output) port 11 through which signals from various panel switches 15, provided on the operating panel of the printer, or signals from various sensors 17, provided at individual portions of the printing mechanism, are input to the MPU 1. Connected to the I/O port 11 via a driving circuit 19 are a carriage motor 21, a line feed (LF) motor 23 for feeding paper, a printing head 25, and various kinds of panel LED's 27 provided on the operating panel. Drive signals are output to the carriage motor 17, LF motor 23, printing head 25 and panel LED's 27 via the I/O port 11 and the driving circuit 19.

Figure 2:
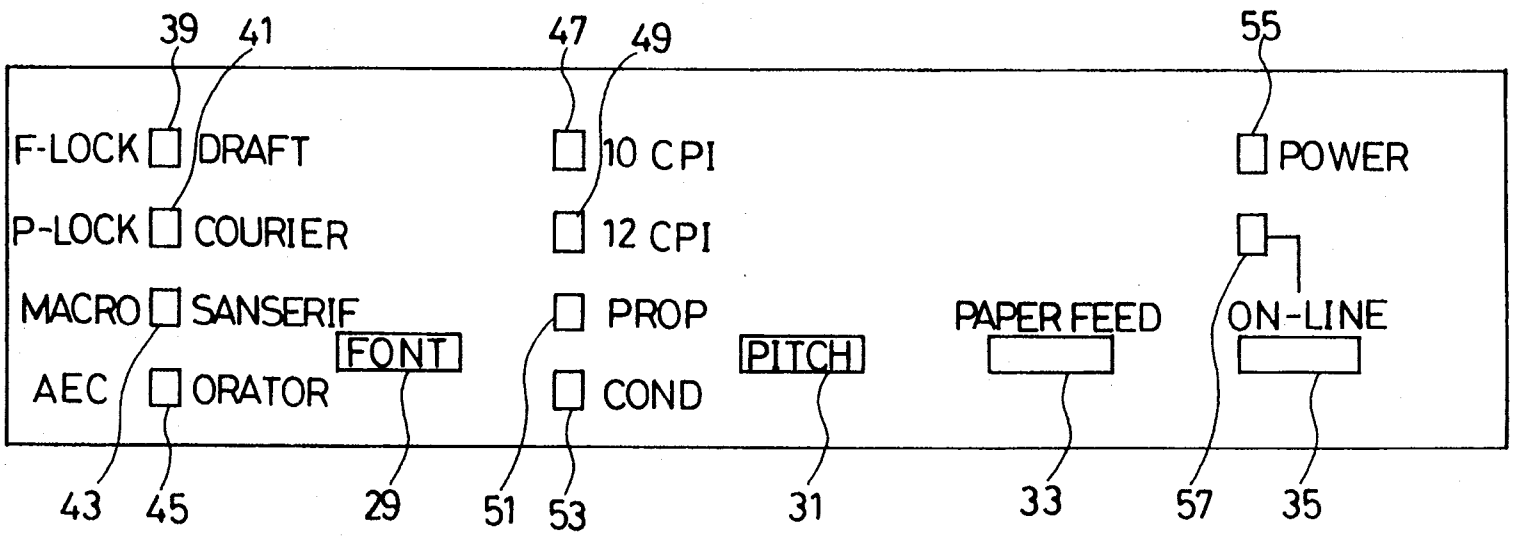
FIG. 2 is a diagram showing a panel display portion of this embodiment in off-line mode.
Figure 3:
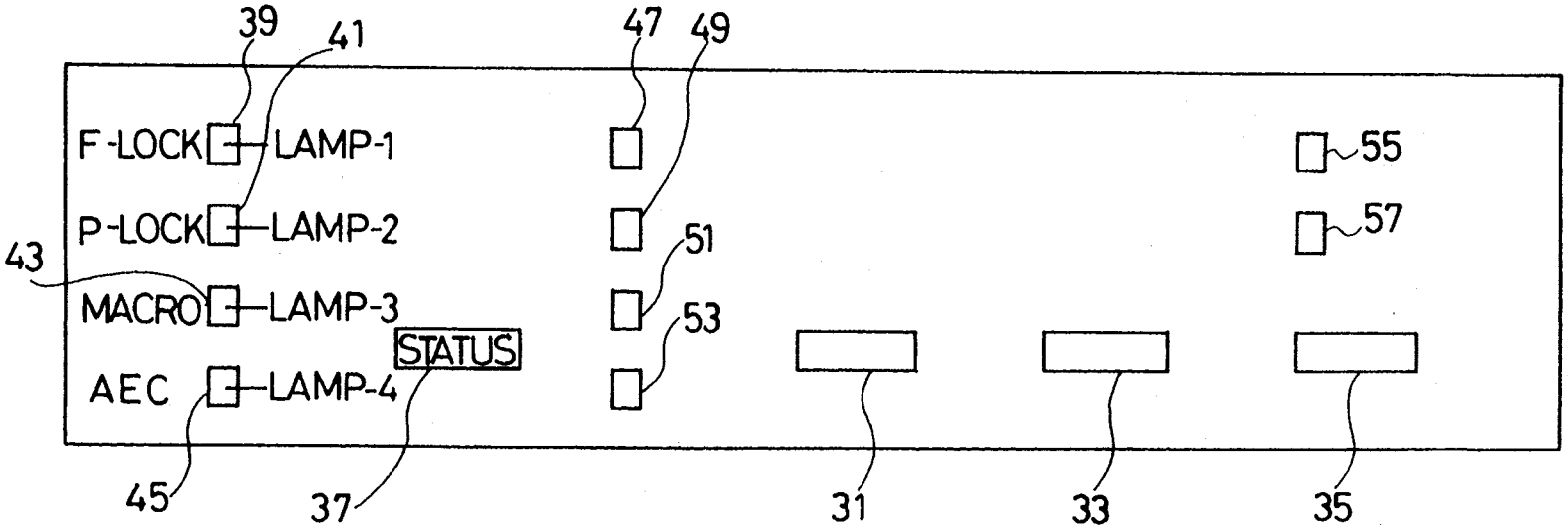
FIG. 3 is a diagram showing the panel display portion of this embodiment in on-line mode.

Now, the panel structure of the printer according to this embodiment will be described referring to FIGS. 2 and 3. FIG. 2 shows the panel structure in off-line mode while FIG. 3 shows the panel structure in on-line mode. The reason why the panel structure in off-line mode differs from that in on-line mode even on the same panel is because certain switches serve different functions between the off-line mode and the on-line mode. The panel structure in off-line mode will be described as the basic structure. The switches (the panel switches 15 shown in FIG. 1) include a FONT switch 29, a PITCH switch 31, a PAPER FEED switch 33, and an ON-LINE switch 35. Of those switches, the FONT switch 29 is one of the aforementioned certain switches, and becomes a STATUS switch 37 as a changeover switch in on-line mode as shown in FIG. 3.

The light indicating portions (the panel LED's 27 in FIG. 1) include LED lamps 39 to 57. Of those LED lamps, the LED lamps 39 to 45 are used to indicate the types of fonts in off-line mode and indicate different contents in on-line mode. More specifically, the LED lamp 39 serves to indicate "DRAFT" in off-line mode and "F-LOCK" in on-line mode. Likewise, the LED lamp 41 is used to indicate "COURIER" in off-line mode and "P-LOCK" in on-line mode. The LED lamp 43 is used to indicate "SANSERIF" in off-line mode and "MACRO" in on-line mode. Further, the LED lamp 45 is used to indicate "ORATOR" in off-line mode and "AEC" in on-line mode.

The LED lamps 47 to 53 are used to indicate character pitches: the LED lamp 47 indicates "10 CPI," the LED lamp 49 "12 CPI," the LED lamp 51 "PROP," and the LED lamp 53 "COND." The LED lamp 55 indicates whether or not power is given, and the LED lamp 57 indicates whether or not the printer is in the on-line mode.

Figure 6:
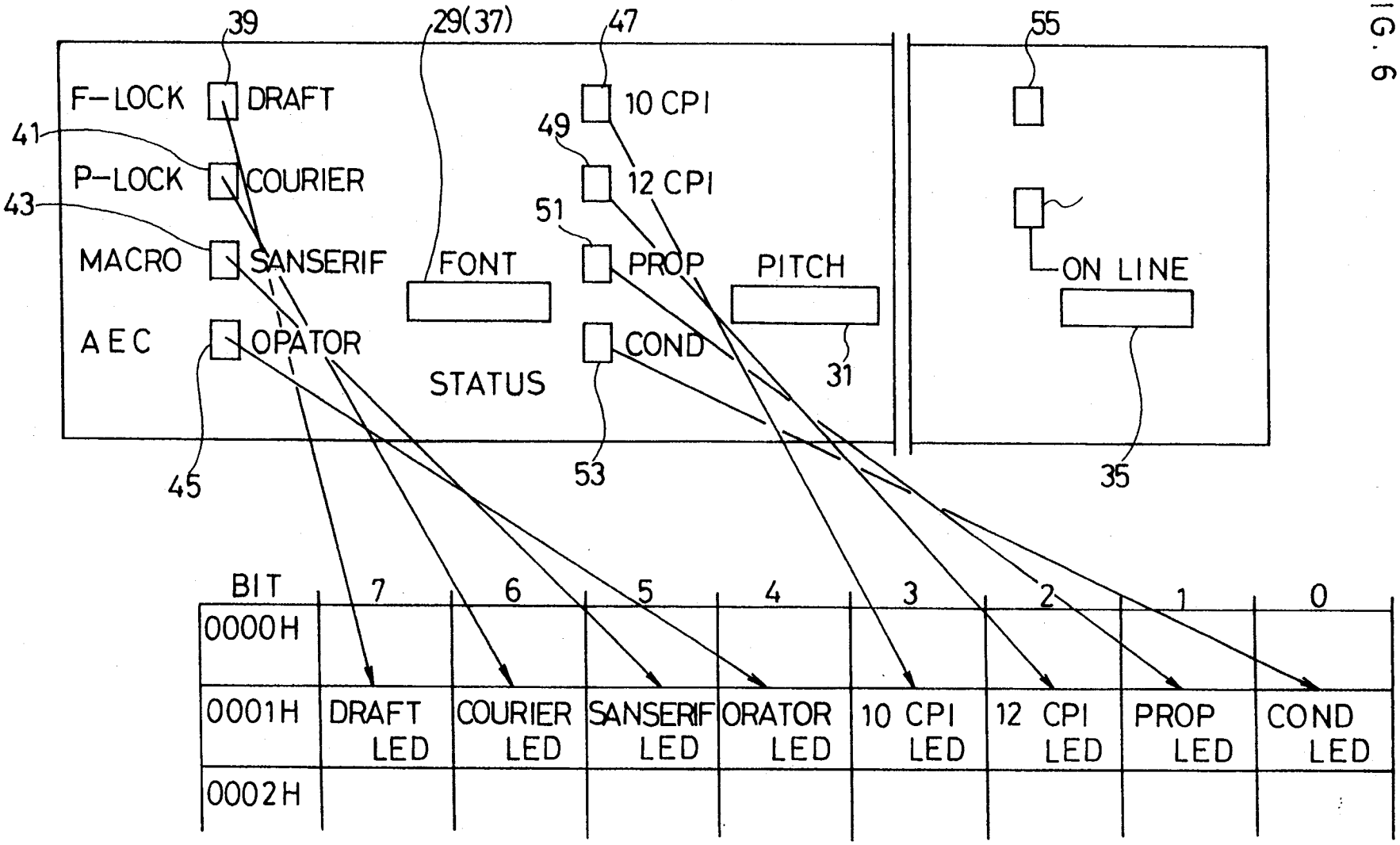
FIG. 6 is a diagram for explaining how individual bits of an address "0001H" of an I/O (input/output) port, which is assigned to a latch circuit, are associated with the individual LED lamps according to this embodiment.

FIG. 6 illustrates how individual bits (eight in total) of an I/O address "0001H" of the I/O port 11, which is assigned to a latch circuit (not shown) for driving the LED lamps, are associated with the individual LED lamps 39 to 53 on the operating panel. In this diagram, those associated with one another are connected by lines. When data of "FFH" is written at the I/O address "0001H" through the operation of the MPU 1, all of the eight LED lamps corresponding to the individual bits are turned on. When data of "00H" is written at the I/O address "0001H," all the eight LED lamps are turned off. When data of "48H" is written at the I/O address "0001H," two LED lamps 41 and 47 are turned on. It is possible to know the lighting status by causing the MPU 1 to read the status of the I/O address "0001H."

The printer according to this embodiment will indicate some special modes which are associated with the validity/invalidity of several received commands, without complicating the structure of the display portion. Such modes are not indicated on the panel in the prior art. A description will now be given of those special modes which include lock modes, a macro command mode, and auto-emulation change mode (hereinafter referred to as "AEC mode"), for example. The lock modes, the macro command mode and the AEC mode will be described in detail below.

The lock modes are a font-lock (F-LOCK) mode and a pitch-lock (P-LOCK) mode. The font-lock mode gives the font designation by the panel operation a priority over the font designation, if given, from the host computer 8 and disregards the latter font designation when the printer is in use or printing. The "font designation" means the designation of an arbitrary one of a plurality of resident fonts or optional fonts. This font-lock mode is selected by, for example, throwing the power switch while depressing the FONT switch 29. When this font-lock mode is selected, the depression of the FONT switch 29 is detected and a flag for storing and holding the setting of the font-lock mode (font-lock flag or F-LOCK flag) is set on in the RAM 5 in the starting program-oriented process at the power ON time. When font designation is given from the host computer 8 during the printing operation, the F-LOCK flag is referred to and this font designation will be neglected.

The pitch-lock mode gives the designation of a character pitch (e.g., 10 CPI, 12 CPI, proportional, or condense) set by the panel operation a priority over the pitch designation given from the host computer 8 and disregards the latter pitch designation. This pitch-lock mode is set by, for example, throwing the power switch while depressing the PITCH switch 31. When this pitch-lock mode is set, a pitch-lock (P-LOCK) flag is set on in the RAM 5 as in the case of the font-lock mode. When a pitch command is received from the host computer 8 during the printing operation, the P-LOCK flag is referred to and this pitch command will be neglected. As the font-lock mode and pitch-lock mode are independent modes, only one of the modes may be set or both modes may be set by operating both switches 29 and 31 at the power ON time.

A description will now be given of the macro command mode, which allows the printer to be activated with the previously designated and registered conditions effective, if any, when the power is given. The use of this macro command mode eliminates the troublesome work of designating the font, character pitch, etc. every time the power is given. This macro command mode is set by, for example, depressing both the FONT switch 29 and the PITCH switch 31 for two seconds in off-line mode. When such a switch operation is performed, a short buzzer sound is generated and the contents of the current panel setting are internally registered.

This registration will be described in more detail below. When the depression of the FONT switch 29 is detected in the program-oriented process in off-line mode, it is checked if the PITCH switch 31 is depressed. If the depression of the PITCH switch 31 is also detected, the time measurement starts and the status of both switches 29 and 31 are monitored. When the depression of both switches 29 and 31 continues for two seconds, the currently designated contents of the font and character pitch are read from the RAM 5 and written as macro data in the EEPROM 9. At the same time, a macro flag indicating the setting of the macro command mode is stored in the EEPROM 9. With this macro command mode set, when the power is given, the information stored in the EEPROM 9 is referred to. If this information indicates that the macro flag is set to the macro command mode, the macro-flag data is read from the EEPROM 9 and written in the RAM 5, causing a specific designated mode to be automatically set at the time the printer is activated.

The AEC mode will now be described. Generally speaking, the control command data sent to each printer should conform to the control command code specifications of that printer. Printers available on the market are, however, classified into several groups depending on the manufacturers and the types or groups of standard host computers 8 to which the printers are to be connected, and there is no compatibility between those groups. To ensure the use of many printers available on the market, application programs which run on the host computer 8 are designed to allow a user to designate a printer in use and convert control commands and printing data, which are to be sent to that printer, into proper codes for the printer.

As there are many groups of control commands, the user should know the category (or type) of the printer designated and registered in an application software. If a wrong printer type is specified, the printer in use would receive a wrong group of control commands and might not provide a desired printing result. This shortcoming is overcome by the so-called AEC mode. In this AEC mode, control commands sent from the host computer 8 are temporarily stored without being processed, and it is determined to which group those control commands belong from the types of the control commands or a combination pattern thereof. Based on the discrimination result, the proper emulation is selected and executed from a plurality of previously prepared emulations corresponding to individual control command groups. With the AEC mode disabled, only the commands of a specific control command group become valid based on the information designated by DIP switches (not shown) or emulation designation data stored in the EEPROM 9, and the other groups of commands will be ignored.

The AEC mode is set, for example, by operating the DIP switches or based on AEC flag data stored in the EEPROM 9. The data writing in the EEPROM 9 can be enabled or disabled, as desired, by the user performing a specific operation of the panel switches 15. When the power is given, the set status of the DIP switches or the set status of the EEPROM 9 is read in the starting program routine. With the AEC flag set on, the AEC mode is executed and all the groups of commands become valid or enabled. If the AEC flag is set off, available control commands are limited to those of a specific control command group designated by the DIP switches or the emulation designation data stored in another area in the EEPROM 9. The AEC mode may be temporarily selected by a specific operation on the operating panel, in which case the contents of the EEPROM 9 are not altered and only the AEC flag data sent to the work area of the RAM 5 is rewritten to enable the AEC mode.

Figure 4:
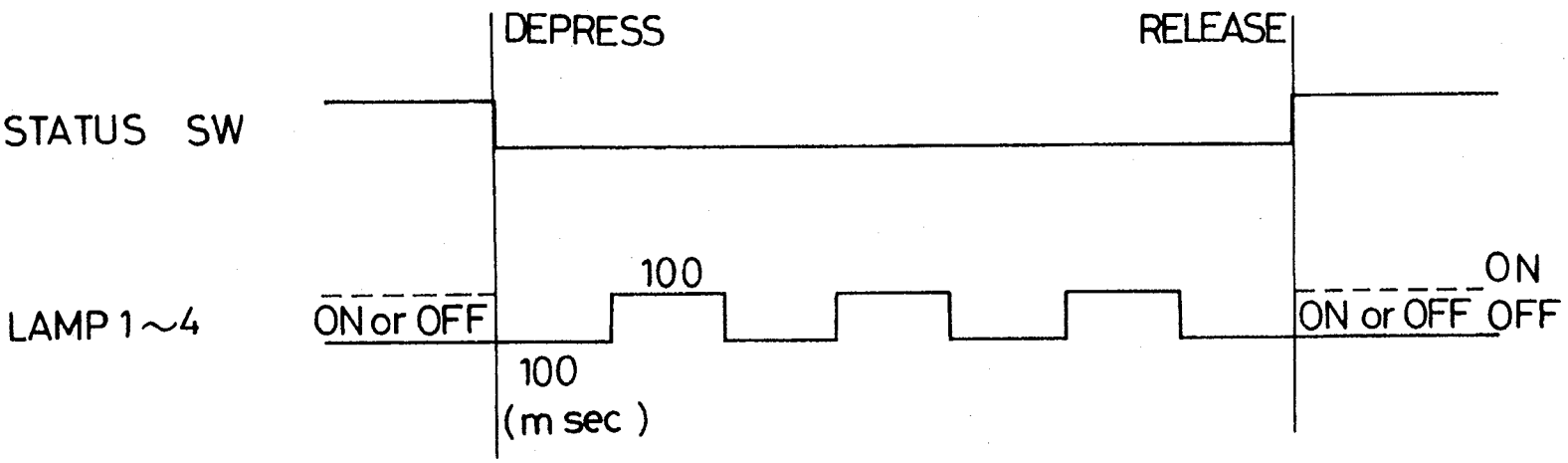
FIG. 4 is a diagram showing the relation of the depression of a STATUS switch and the lighting of LED lamps in this embodiment.
Figure 5A:
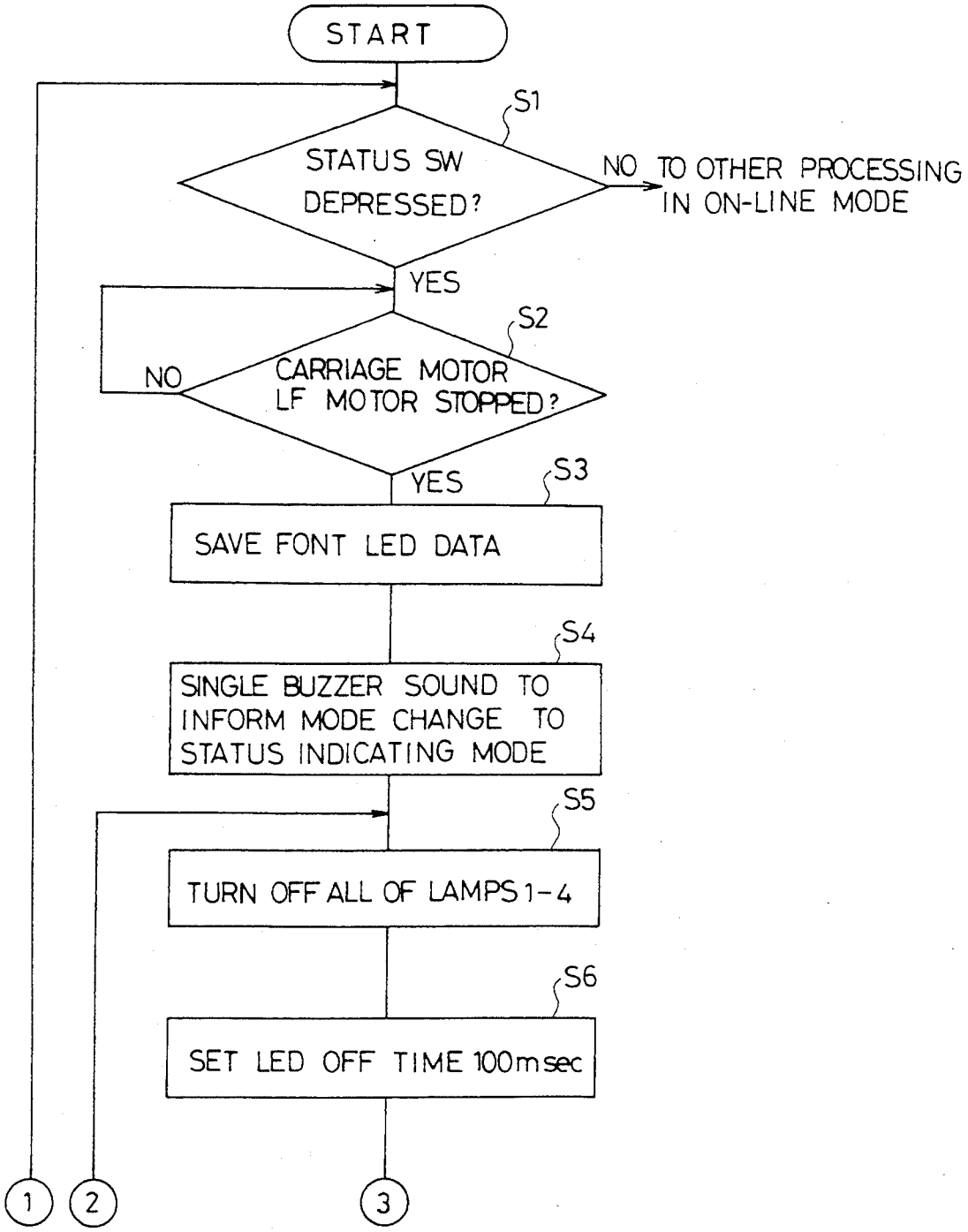
FIG. 5A and FIG. 5B are a flowchart illustrating a sequence of processes in status indicating mode according to this embodiment.
Figure 5B:
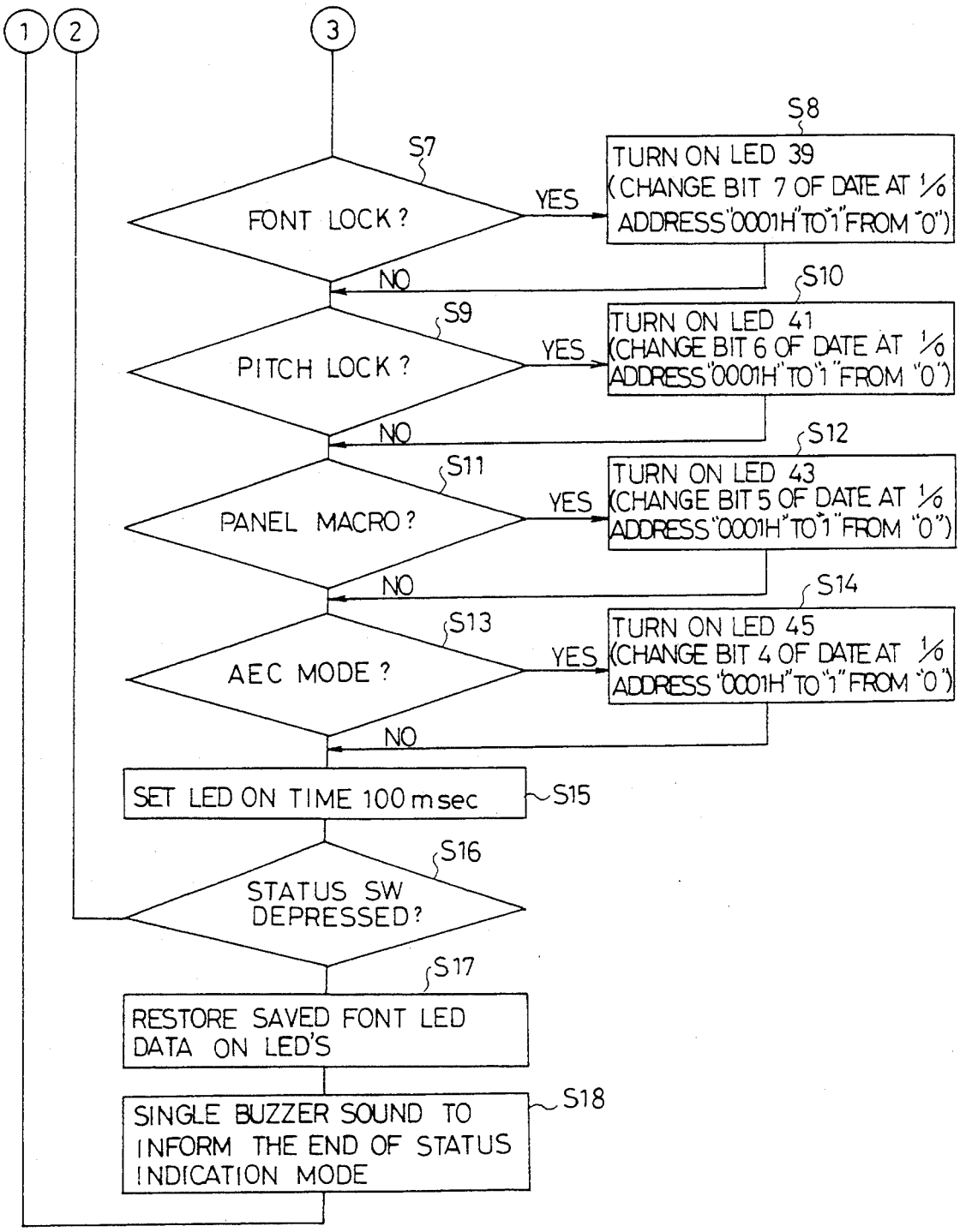
Figure 7:
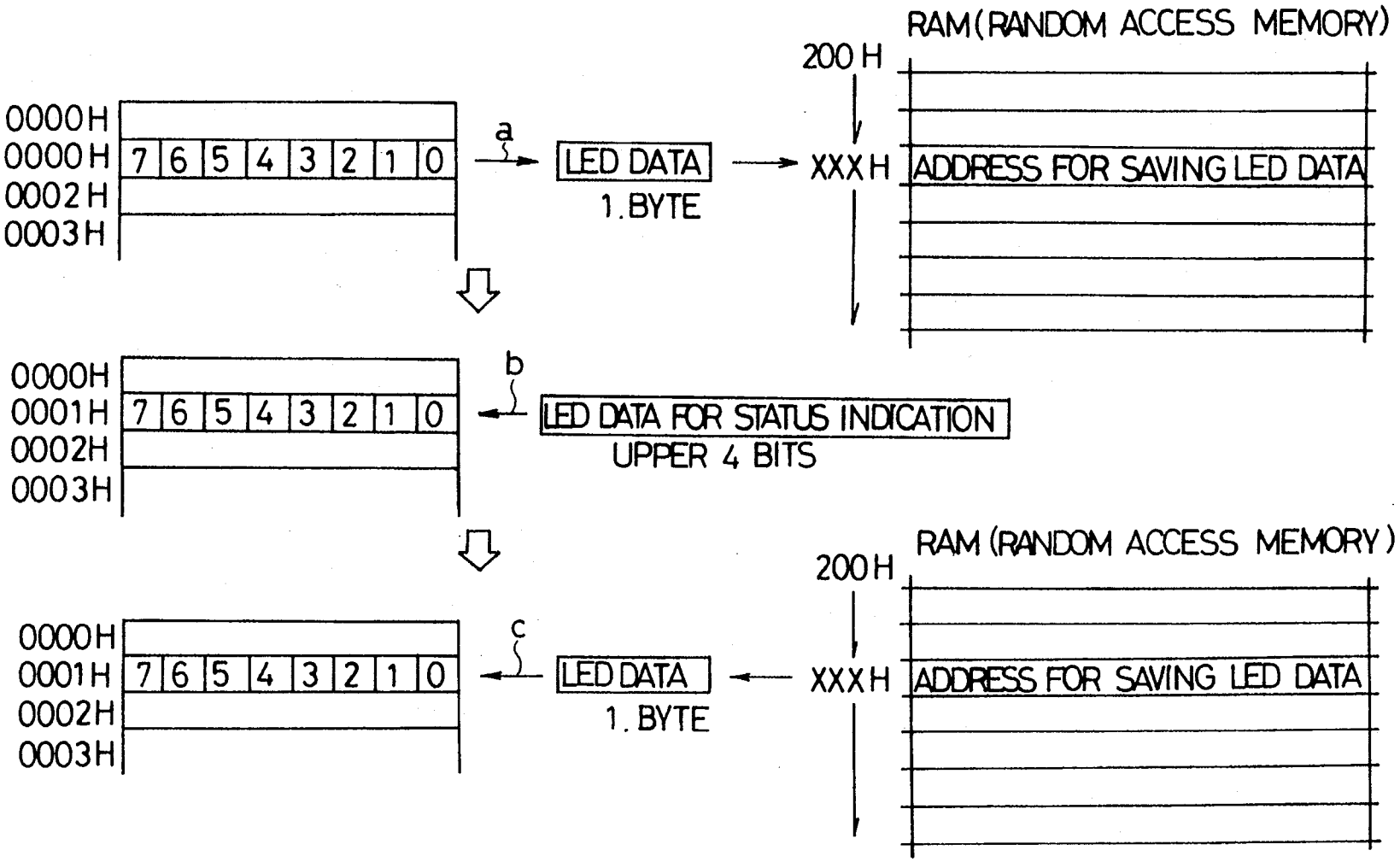
FIG. 7 is a diagram for explaining a latch process during a sequence of processes in status indicating mode according to this embodiment.

Referring to FIG. 4 and the flowchart of FIG. 5A and FIG. 5B, a description will be given of what indication is actually made. First, the printer is set in on-line mode. It is then discriminated whether or not the STATUS switch is depressed (step S1). The STATUS switch 37 is the switch the user should depress to see what special mode is currently set. If the STATUS switch 37 is not depressed, other on-line processing will be executed. With the STATUS switch 37 depressed, however, it is checked whether or not the printer is printing (step S2). If the printer is printing, the discrimination in step S2 is repeated. If the printer is not printing, on the other hand, lighting data of the LED lamps 39 to 45, which indicates the selected font type is stored in off-line mode (step S3). The arrow a in FIG. 7 represents the flow of data at that time, in which data at the I/O address "0001H" is read out and is stored at an LED data saving address in the work area of the RAM 5. Then, a buzzer sound is generated once to indicate that the mode has been changed to the status indicating mode as a special indicating mode from the normal indicating mode (step S4).

Through the above-described sequence of processes, the mode is changed to the status indicating mode from the normal indicating mode. Then, "00H" is written at the I/O address "0001H" to turn off all of the LED lamps 39 to 45 as mentioned earlier (step S5) and the time in which the LED lamps 39 to 45 are turned off is set to 100 msec (step S6). From this point, the sequence enters the stage at which the set status of various special modes is checked and indicated, if any. First, the status of the F-LOCK flag in the RAM 5 is tested to discriminate if the font-lock mode has been set (step S7). If the font-lock mode is currently set, the LED lamp 39 is turned on (step S8). Next, the status of the P-LOCK flag in the RAM 5 is tested to discriminate if the pitch-lock mode has been set (step S9). If the pitch-lock mode is currently set, the LED lamp 41 is turned on (step S10). Then, the macro flag in the RAM 5 is tested to discriminate if the macro mode has been set (step S11). If the macro mode is currently set, the LED lamp 43 is turned on (step S12). Further, the AEC flag in the RAM 5 is tested to discriminate if the AEC mode has been set (step S13). If the AEC mode is currently set, the LED lamp 45 is turned on (step S14). The time in which the LED lamps 39 to 45 are turned on is set to 100 msec (step S15). In this manner, the user can confirm whether or not the font-lock mode, pitch-lock mode, macro mode and AEC mode are set, by checking the presence or absence of flickering conditions of the associated LED lamps 39–45. The arrow b in FIG. 7 represents the flow of data that is written at the I/O address "0001H" during the sequence of steps S7 to S14; the upper four bits of the data are altered.

Then, it is discriminated whether or not the STATUS switch 37 is depressed (step S16). If the STATUS switch 37 is depressed, the flow returns to step S5 and the above-described sequence of processes will be repeated. In other words, the above-described indication is maintained while the STATUS switch 37 is depressed. As a result, any LED lamp, which is lit when the associated special mode is set, flickers. If the STATUS switch 37 is not depressed, on the other hand, the previous stored lighting data of the LED lamps 39-45 is restored on the LED's (step S17) and a buzzer sound is generated once to indicate the end of the status indicating mode (step S18). This completes the status indicating mode and restores the normal indicating mode. The arrow c in FIG. 7 represents the flow of data in step S17, in which the data stored in the RAM 5 is returned to the latch circuit at the I/O address "0001H" and the LED lamps return to the original lighting conditions.

The timing of the depression of the STATUS switch 37 and the timing of the lighting of the LED lamps 39–45 have the relationship as shown in FIG. 4. When the STATUS switch 37 is depressed, all the LED lamps 39–45 are temporarily turned off, and then the standby time is set to 100 msec (step S6). After the standby time has elapsed, the flickering of the LED lamps 39–45 starts. The lamps are turned on or off every 100 msec (step S15). When the depression of the STATUS switch 37 is released, the flickering of the LED lamps 39–45 stops.

This embodiment has the following advantages. The user can check the setting of several special modes on the panel, which was not conventionally possible, without increasing the number of the LED lamps as the light indicating portions. More specifically, the depression of the STATUS switch 37 by the user changes the mode to the status indicating mode from the normal indicating mode, so that the user can determine if some special modes are currently set by checking the flickering of the LED lamps 39–45. The mode will not be changed to the status indicating mode unless the user depresses the STATUS switch 37. That is, the mode is changed to the status indicating mode only when the user desires the mode change. This design reduces the possibility of erroneous mode confirmation.

According to this embodiment, since the LED lamps 39–45 are made to flicker in the status indicating mode, the user can easily confirm that the mode is currently set to the status indicating mode, not the normal indicating mode, and can also surely confirm if the individual special modes are currently set.

The present invention is not limited to the above-described embodiment. The type of the printer is not restricted to a specific type, and this invention can be applied to various types of printers. The light indicating portions are not limited to those using LED's, but may use other means. The special modes are not limited to the various lock modes, the macro mode and the AEC mode, but this invention can be applied to other modes as well.

What is claimed is:

1. A printer, connected to a high rank apparatus, for making a printout in accordance with printing data containing a control command sent from said high rank apparatus, said printer comprising:

control means for changing and controlling a printing mode according to a specific control command sent from said high rank apparatus;

memory means for storing predetermined set dam;

inhibiting means for inhibiting a control operation of said control means associated with said specific control command sent from said high rank apparatus in accordance with set contents of said set data, thereby disabling reception of said specific control command; and indicating means for indicating said set contents of said set data in a mode in which said printer is ready to receive a control command from said high rank apparatus.

2. The printer as claimed in claim 1, further comprising switching means for switching indication contents of said indicating means, whereby indication of said indicating means is switched between indication of said set contents of said set data and indication of a selected status of said printing mode for printing printing data on a printing medium in accordance with a switching operation of said switching means.

3. The printer as claimed in claim 2, wherein an indicating mode for indicating said set contents of said set data differs from an indicating mode of indicating said selected status of said printing mode.

4. The printer as claimed in claim 1, wherein said indicating means comprises a plurality of light emitting portions.

5. The printer as claimed in claim 2, wherein a switch serving as a FONT switch in off-line mode is used directly as a changeover switch serving as said switching means in on-line mode.

6. The printer as claimed in claim 3, wherein said set contents of said set data is indicated by switching on and off said light emitting portions and said selected status of said printing mode is indicated by keeping said light emitting portions on.

7. The printer according to claim 2, wherein said indicating means comprises a plurality of light emitting portions.

8. The printer according to claim 3, wherein said indicating means comprises a plurality of light emitting portions.

9. The printer according to claim 7, wherein said set contents of said set data is indicated by switching on and off said light emitting portions and said selected status of said printing mode is indicated by keeping said light emitting portions on.

10. The printer according to claim 8, wherein said set contents of said set data is indicated by switching on and off said light emitting portions and said selected status of said printing mode is indicated by keeping said light emitting portions on. REMARKS 11. A printer according to claim 1, wherein said indicating means is operable in a plurality of conditions and wherein said indicating means changes from a first condition of said plurality of conditions to a second condition of said plurality of conditions to indicate said set contents of said set data.

12. A printer according to claim 11, further comprising switching means for switching indication contents of said indicating means, whereby indication of said indicating means is switched between indication of said set contents of said set data and indication of a selected status of said printing mode for printing printing data on a printing medium in accordance with a switching operation of said switching means, said indicating means including a plurality of light emitting devices.

13. A printer according to claim 12, wherein said set contents of said set data is indicated by switching said light emitting devices into an on-and-off condition for said predetermined time period and said selected status of said printing mode is indicated by keeping said light emitting devices in an on condition.

14. A printer according to claim 13, wherein said switching means includes a switch, said switch being a FONT line switch when said printer is in an off-line mode and said switch being a changeover switch when said printer is in an on-line mode.

* * * * *